US009637205B1

(12) United States Patent
Saunooke

(10) Patent No.: US 9,637,205 B1
(45) Date of Patent: May 2, 2017

(54) CURVED SURFBOARD FIN

(71) Applicant: Jacob Saunooke, Hermosa Beach, CA (US)

(72) Inventor: Jacob Saunooke, Hermosa Beach, CA (US)

( * ) Notice: Subject to any disclaimer, the term of this patent is extended or adjusted under 35 U.S.C. 154(b) by 0 days.

(21) Appl. No.: 14/979,902

(22) Filed: Dec. 28, 2015

(51) Int. Cl.
*B63B 35/00* (2006.01)
*B63B 35/79* (2006.01)

(52) U.S. Cl.
CPC ..... *B63B 35/7926* (2013.01)

(58) Field of Classification Search
CPC ..... B63B 35/7926
USPC ..... 441/74
See application file for complete search history.

(56) References Cited

U.S. PATENT DOCUMENTS 4,493,665 A 1/1985 Liddle
D397,394 S 8/1998 Akins
6,106,346 A 8/2000 Bolen
D437,907 S 2/2001 Stuart et al.
6,322,413 B1 * 11/2001 Webber ..... B63B 35/7926 441/79
6,811,456 B2 11/2004 Redmon
8,613,636 B2 12/2013 Mead
8,651,813 B2 2/2014 Long
D702,304 S 4/2014 Potter
8,821,205 B2 9/2014 Mead
2008/0311806 A1 * 12/2008 Mead ..... B63B 35/7926 441/74
2010/0087111 A1 4/2010 De Witt
2010/0303634 A1 * 12/2010 Long ..... B63B 35/7926 416/90 A
2015/0104988 A1 4/2015 Potter

* cited by examiner

*Primary Examiner* — Stephen Avila
(74) *Attorney, Agent, or Firm* — Maxey Law Offices, PLLC; Stephen Lewellyn

(57) ABSTRACT

A surfboard fin has a curved forward fin portion and a straight rearward fin portion. When attached to a surfboard, the curved forward portion is positioned on the surfboard so the curvature of the forward portion is directed toward the centerline of the surfboard. The concave curve of the forward portion allows for faster and easier maneuverability of a surfboard while in use. In order to reduce drag caused by the curvature of the forward fin portion, one or more through holes may be formed through the forward fin portion to allow water to pass through the fin and reduce drag.

12 Claims, 3 Drawing Sheets

CURVED SURFBOARD FIN

FIELD OF THE INVENTION

The present invention relates generally to fins for use on aquatic-sports boards, and more particularly, relating to a curved surfboard fin having a construction that reduces effort and time to change the direction of a surfboard traveling through water.

BACKGROUND OF THE INVENTION

Surfboard fins have been in use for years. A conventional surfboard fin is comprised of a planar material and oriented parallel to the forward direction and to the length of a surfboard. In a side view, the body of a conventional fin is widest at the base, or the portion attached to the surfboard, and narrower at the tip. The planar material used to form a conventional fin is thickest at the base and becomes thinner toward the tip of the fin. Finally, a conventional fin is thickest at the front of the fin and becomes thinner toward the tail of the fin, this allows for greater efficiency moving through the water. This conventional fin can be designed to be removably or permanently attached to the bottom of the surfboard.

Orienting a surfboard fin parallel to the length of the surfboard allows for natural forward motion of the surfboard. However, to change the direction of the surfboard, the user has to point the surfboard in an alternate direction requiring the fin to change direction. Changing the fin direction is difficult because the fin is specifically designed to resist a directional change and keep the surfboard pointing in a forward direction. The resistance by the fin against turning increases drag on the surfboard causing the surfboard to lose speed while turning.

Accordingly, there is a need and desire for a new surfboard fin that allows the surfboard to turn quicker with lower rider effort and with minimal speed loss.

SUMMARY OF THE INVENTION

In view of the foregoing problems with existing surfboard fins, embodiments of the present invention provide a new curved surfboard fin that substantially departs from the concepts and designs of the prior art, and in doing so provides an new surfboard fin that reduces the effort required by a user to change the direction of a surfboard, thereby increasing maneuverability and reducing turning time and speed loss.

In general, in one aspect, a curved surfboard fin is provided that has a forward fin portion that is curved to be out of parallel with the forward travel of the surfboard.

In general, in another aspect, a curved surfboard fin is provided that includes an elongated body having a trailing edge, a leading edge, a length extending from the trailing edge to the leading edge, an outward side surface, and an inward side surface opposite the outward side surface. The outward side surface and the inward side surface extend along the length from the trailing edge to the leading edge. The length is divided into a forward fin portion and a rearward fin portion. The outward side surface has a first concave curvature along the forward fin portion and the outward side surface is straight along the rearward fin portion. The inward side surface has a second concave curvature along the forward fin portion and the inward the surface is straight along the rearward fin portion. And the first concave curvature and the second concave curvature are formed in the same direction.

In general, in yet another aspect, the elongated body defines at least one through hole formed through the forward fin portion and extending through the inward side surface and the outward side surface.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
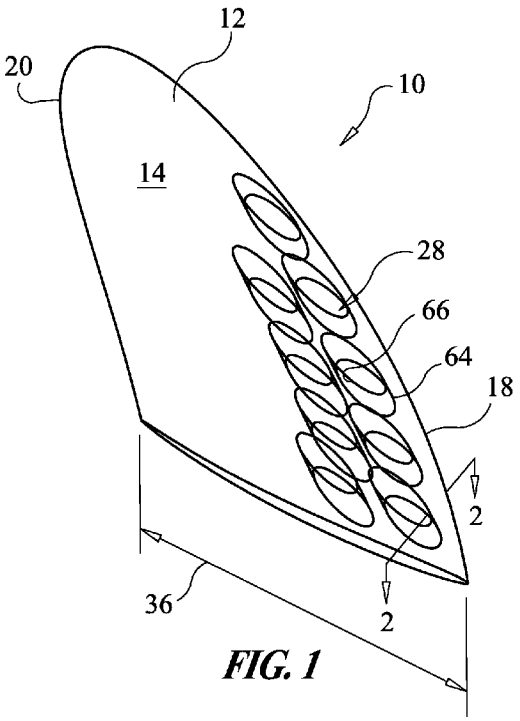
FIG. 1 is a front perspective view of a curved surfboard fin constructed in accordance with the principles of an embodiment of the present invention.
Figure 2:
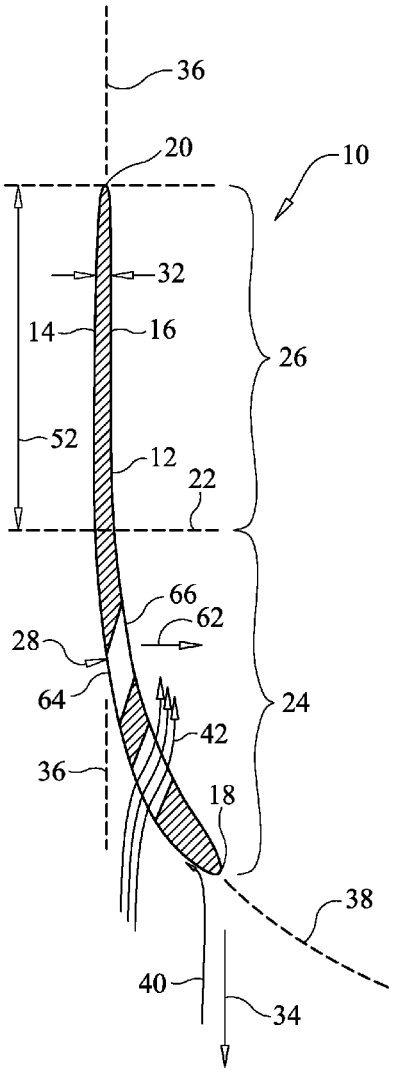
FIG. 2 is a cross-sectional view of the curved surfboard fin taken along the line 2-2 in FIG. 1.
Figure 3:
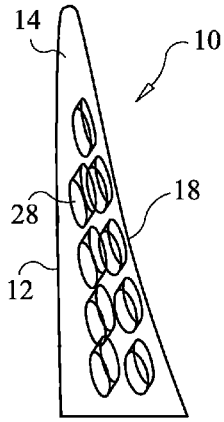
FIG. 3 is a front elevation view of the curved surfboard fin constructed in accordance with the principles of an embodiment of the present invention.
Figure 4:
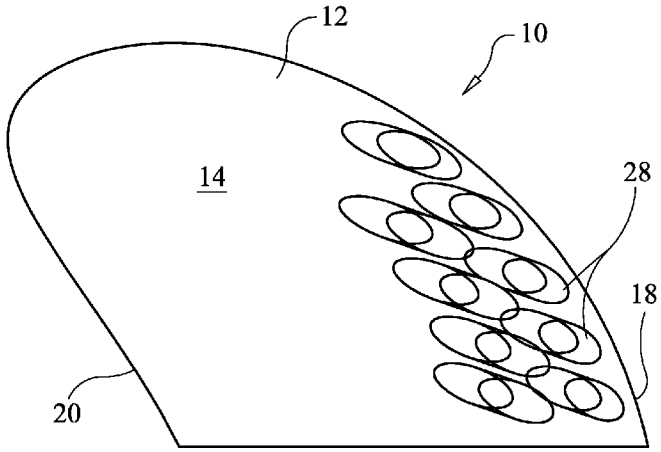
FIG. 4 is a side elevation view of the curved surfboard fin constructed in accordance with the principles of an embodiment of the present invention.

With reference to FIGS. 1-4, there is representatively illustrated a new curved surfboard fin that is constructed in accordance with an embodiment of the present invention and is designated by reference number 10. As discussed in more detail below, surfboard fin 10 has a unique construction including a rearward fin portion that is straight and a forward fin portion that is curved in an inwardly direction relative to a centerline of a surfboard to which it is attached. This unique fin construction has the advantage of increasing the ability to change direction of the surface board with reduced effort and time as compared to a conventional surfboard fin.

In the representatively illustrated embodiment, the curved surfboard fin 10 has an elongated body 12 that has an outward side surface 14, an opposing inward side surface 16, a leading edge 18, and a trailing edge 20. The elongated body 12 has a length 30 that extends from the leading edge 18 to the trailing edge 20. The outward and inward side surfaces 14 and 16 extend along the length 30 from the leading edge 18 to the trailing edge 20 and are separated by a thickness 32. The thickness 32 can be greater at the leading edge 18 than it is at the trailing edge 20 such that the body 12 tapers from wide to narrow in a direction from the leading edge to the trailing edge.

The body 12 includes a forward fin portion 24 and a rearward fin portion 26. More specifically, as shown, the length 30 of the body 12 is divided into two sections comprising the forward fin portion 24 and the rearward fin portion 26. The transition between the forward fin portion 24 and the rearward fin portion 26 is generally designated by line 22.

The rearward fin portion 26 of the elongated body 12 extends from the trailing edge 20 to line 22 and, in cross-section, is straight along its entire length between the trailing edge and line 22. Representatively, the rearward fin portion 26 extends generally along straight line 36 from the trailing edge 20 to the line 22. Likewise, the portions of the inward and outward side surfaces 14 and 16 that extend along the rearward fin portion 26 are also straight in cross-section.

The forward portion 24 of the elongated body 12 extends from line 22 to the leading edge 18 and, in cross-section, is curved along its entire length in the general direction 62. Representatively, the forward fin portion 24 extends generally along a concave curved line 38 that extends from the straight line 36. Likewise, the portions of the outward and inward side surfaces 14 and 16 that extend along the forward fin portion 24 are also curved in cross-section.

In the illustrated embodiment, the length of the rearward fin portion 26 is about one-third the overall length of the elongated body 12. However, the curved surfboard fin 10 may be construction such that the length of the rearward fin portion 26 is between 20 and 80% of the length of the surfboard fin.

When attached to a surfboard, the forward fin portion 24 curves inwardly toward the centerline of the surfboard and is concaved with respect to the centerline. Similarly, the outward and inward side surfaces 14 and 16 that extend along the forward fin portion 24 are concaved toward the centerline of the surfboard. The degree of concave curvature of the inward and outward side surfaces 14 and 16 may be the same or dissimilar.

The curved surfboard fin 10 may include one or more holes 28 formed through the forward fin portion 24. In the representatively illustrated embodiment, a plurality of holes 28 is formed through the forward fin portion 24 in a spaced relation to one another. Each hole 28 has a forward edge 64 on the outward side surface 14 and a rearward edge 66 on the inward side surface 16. As the fin 10 moves forward 34 through the water, the apparent opposite flow of water 40 presses against the outward side surface 14 of the fin 10, creating drag. The holes 28 allow water 42 to pass from the outward side surface 14 to the inward side surface 16, thereby reducing drag on the surfboard fin 10.

Figure 5:
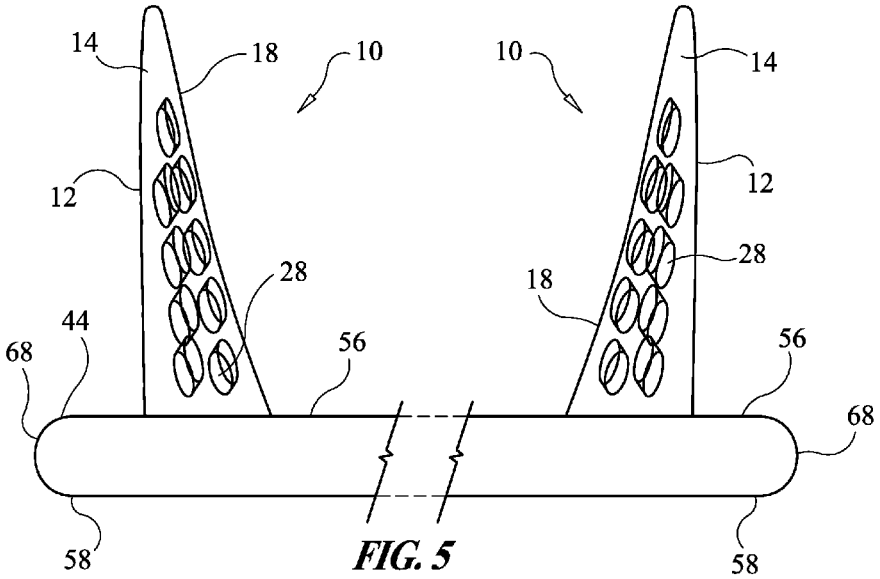
FIG. 5 is a partial front elevation view of a surfboard having pair of curved surfboard fins attached to a surfboard in accordance with the principles of an embodiment of the present invention.
Figure 6:
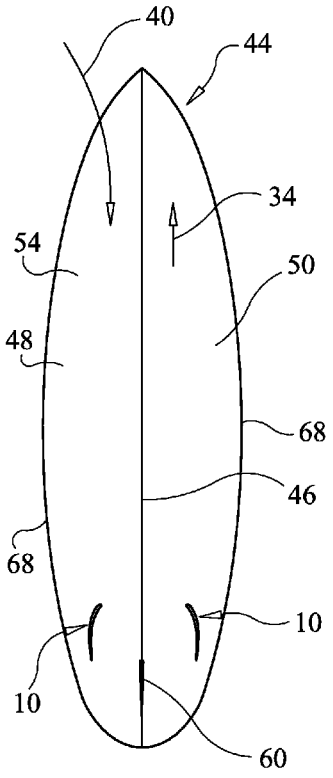
FIG. 6 is a bottom plan view of a surfboard having a pair of curved surfboard fins attached to the surfboard in accordance with the principles of an embodiment of the present invention.
Figure 7:
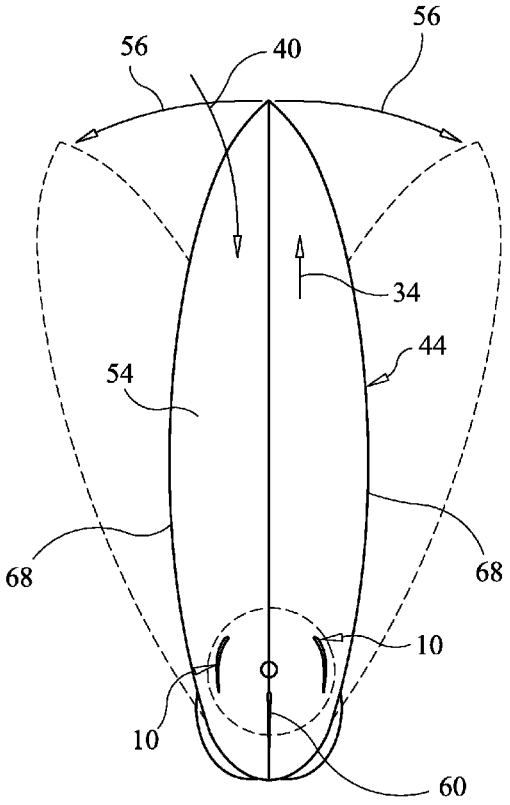
FIG. 7 is a bottom plan view of a surfboard having a pair of curved surfboard fins attached to the surfboard in accordance with the principles of an embodiment of the present invention, and demonstrating the surfboard being turned.

With reference now to FIGS. 5-7, there is shown a surfboard 44 having a pair of curved surfboard fins 10 secured to the surfboard. Conventionally, surfboard 44 has a top surface 58 that a user generally stands on while riding the surfboard 44, a bottom surface 54 that faces down toward the water 40, and a center line 46. The center line 46 divides the bottom surface 54 of the surfboard 44 into two equal halves 48 and 50.

The curved surfboard fins 10 are each mounted to the bottom surface 54 of the surfboard 44. The fins 10 should be mounted opposite the center line 46 from one another, near the peripheral edge 68 of the surfboard 44. The forward fin portion 24 of each surfboard fin 10 curves inwardly toward the center line 46 of the surfboard 44. This allows a user to constantly have the leading edge 18 of each surfboard fin 10 pointing in the direction of a turn 56, thus easing the effort required to turn 56 the surfboard 44 in either direction.

While the foregoing discussion is made in reference to a curved surfboard fin, one of ordinary skill in the art will readily recognize that the principals of the curved fin construction of the present invention could be used in other applications, such as, but not limited to, paddle boards, sailboards, yachts, boats, ships, and other keeled vessels. Nevertheless, it will be understood that various modifications may be made without departing from the spirit and scope of the invention and the following claims.

What is claimed is:

1. A curved surfboard fin comprising:

an elongated body having a trailing edge, a leading edge, a length extending from said trailing edge to said leading edge, an outward side surface, and an inward side surface opposite said outward side surface, wherein said outward side surface and said inward side surface extend along said length from said trailing edge to said leading edge;

wherein said length is divided into a forward fin portion and a rearward fin portion;

wherein said outward side surface having a first curvature along said forward fin portion and said outward side surface being straight along said rearward fin portion;

wherein said inward side surface having a second curvature along said forward fin portion and said inward said surface being straight along said rearward fin portion; and wherein said first curvature and said second curvature are formed in the same direction.

2. The curved surfboard fin of claim 1, wherein said elongated body defines at least one through hole formed through said forward fin portion and extending through said inward side surface and said outward side surface.

3. The curved surfboard fin of claim 2, wherein said at least one through hole has a forward edge on said outward side surface and a rearward edge on said inward side surface.

4. The curved surfboard fin of claim 1, wherein said rearward fin portion has a length between 20 and 80% of said length of said fin.

5. The curved surfboard fin of claim 1, wherein said first curvature and said second curvature have a different degree of curvature.

6. The curved surfboard fin of claim 1, wherein said first curvature and said second curvature have a same degree of curvature.

7. In combination a curved surfboard fins and a surfboard, the combination comprising:

a surfboard having a bottom side face, a tip and tail, and a center line extending from said tip to said tail, wherein said center line divides said surfboard into a first half of said surfboard and a second half of said surfboard;

a first and second curved surfboard fin are attached to said bottom side face with said first curved surfboard fin being positioned on said first half of said surfboard and said second curved surfboard fin being positioned on said second half of said surfboard; and wherein each of said first and second curved surfboard fins comprising:

an elongated body, said elongated body having a trailing edge, a leading edge, a length extending from said trailing edge to said leading edge, an outward side surface, and an inward side surface opposite said outward side surface;

wherein said outward side surface and said inward side surface extend along said length from said trailing edge to said leading edge;

wherein said length is divided into a forward portion and a rearward portion;

wherein said outward side surface having a first curvature along said forward portion and said outward side surface being straight along said rearward portion;

wherein said inward side surface having a second curvature along said forward portion and said inward said surface being straight along said rearward portion; and wherein said first curvature and said second curvature are formed in the same direction.

8. The combination of claim 7, wherein said elongated body of at least one of said first and second curved surfboard fins defines at least one through hole formed through said forward fin portion and extending through said inward side surface and said outward side surface.

9. The combination of claim 8, wherein said at least one through hole has a forward edge on said outward side surface and a rearward edge on said inward side surface.

10. The combination of claim 7, wherein said rearward fin portion of at least one of said first and second curved surfboard fins has a length between 20 and 80% of said length of said fin.

11. The combination of claim 7, wherein said first curvature and said second curvature of at least one of said first and second curved surfboard fins have a different degree of curvature.

12. The combination of claim 7, wherein said first curvature and said second curvature of at least one of said first and second curved surfboard fins have a same degree of curvature.

* * * * *